United States Patent [19]

Marrero et al.

[11] Patent Number: 4,531,472

[45] Date of Patent: Jul. 30, 1985

[54] INDICATOR AND BARRIER ASSEMBLY FOR PARKING SPACE

[76] Inventors: Raul Marrero; Melvin E. Russell, Jr., both of 8460 SW. 47 St., Miami, Fla. 33155

[21] Appl. No.: 554,548

[22] Filed: Nov. 23, 1983

[51] Int. Cl.[3] ..... G08G 1/14; G09F 19/00; F16M 11/38

[52] U.S. Cl. ..... 116/28 R; 116/63 R; 40/612; 248/432

[58] Field of Search ..... 40/601, 604, 606, 612; 116/2, 63 R, 63 P, 16, 28 R; 248/164, 432; 256/1, 24, 64, 73; 404/6, 9

[56] References Cited

U.S. PATENT DOCUMENTS

| | | | |
|---|---|---|---|
| 1,439,318 | 12/1922 | Mallin | 116/63 R |
| 2,737,740 | 3/1956 | Genoe | 256/73 |
| 2,843,391 | 7/1958 | Pelletier | 248/432 |
| 3,456,100 | 7/1969 | Green | 116/63 P |
| 3,877,681 | 4/1975 | Humphrey | 256/64 |
| 4,005,537 | 2/1977 | von Camber et al. | 40/612 |
| 4,354,771 | 10/1982 | Dickinson | 404/6 |

*Primary Examiner*—Charles Frankfort
*Assistant Examiner*—W. Morris Worth
*Attorney, Agent, or Firm*—John Cyril Malloy

[57] ABSTRACT

A combined indicator and blocking assembly structured for mounting on the ground or surface within a designated parking space wherein the assembly includes a head portion selectively positionable upwardly from a base mounted on the surface of the parking space to the extent that the head portion and attendant supporting structure serves as a barrier in preventing unauthorized vehicles to enter the parking space. A sign or other indicator structure may be mounted on the interior surface of a lid element which is attached to the head portion and provided with proper informative indicia. The base is structured to house the head portion therein in a compact assembly when not in use, wherein the assembly has a height sufficient to pass underneath authorized vehicles parking in the space.

15 Claims, 10 Drawing Figures

INDICATOR AND BARRIER ASSEMBLY FOR PARKING SPACE

BACKGROUND OF THE INVENTION

1. Field of the Invention

A combined indicator and barrier structure designed to be selectivity positioned between an upstanding vehicle blocking position and a collapsed orientation wherein the respective positions are intended to either block or allow entry of a vehicle into a given parking space.

2. Description of the Prior Art

Typically in almost all industrial, commercial and even residential areas, a number of specified spaces used for the parking of automobiles, trucks, etc. are reserved and designated for specific vehicles. Due to general overcrowding in highly populated areas, any indication of reserved parking is frequently ignored. This is true whether informative indicia, signs, or the like are placed on the surface of the parking area itself over which the vehicle is parked or in front of the space adjacent to or on a curb structure. This problem exists primarily because while signs, exhibits, etc. are generally clear and informative to the extent of indicating a reserved parking space, they do not perform the function of physically restraining or blocking the vehicle from entering the space. Accordingly, in overcrowded situations or relative emergencies, unauthorized vehicles will enter the space and operators of these vehicles will ignore any indication, exhibit or sign that the space is in fact reserved.

In order to overcome problems of this type, people have resorted to the use of portable barriers, frequently or commonly referred to as "saw horses." These barriers are temporarily positioned within the parking space until the authorized vehicle arrives. The operaor must then remove the barrier from the space and place it in some other designated location or within the vehicle itself. It is frequently inconvenient to find an additional location for storage of the portable barrier. In addition, such portable barriers do not serve their intended purpose since operators of unauthorized vehicles merely move the portable barrier themselves and park in the reserved space after repositioning, discarding or even stealing the portable barrier.

There is a need for a combination barrier and indicator assembly which is capable of informing unauthorized vehicles that a given parking space is in fact reserved while at the same time having a structure designed to prevent entry of the vehicle into the designated space. Such a preferred structure should be capable of being permanently affixed to the parking space so as to prevent theft or unauthorized removal of the barrier. Finally, the overall structure should be such that once permanently installed, the barrier is capable of being disposed in a stored attitude or orientation to allow entry of an authorized vehicle onto a designated space.

SUMMARY OF THE INVENTION

The present invention is directed towards a combined indicator and blocking assembly of the type designed to be substantially permanently affixed on the surface of a parking space within and distanced from the peripheral borders thereof. The assembly comprises a base means having a substantially elongated configuration and a substantially hollow interior portion extending along a majority of the length thereof. A head portion is movably mounted within the interior portion and is interconnected and supported on the base means by support means movably secured to both the head portion and the base means and structured to be collapsible. This collapsible structure serves to allow selective positioning of the head portion in an outwardly extended position substantially defined by disposition of the head portion in spaced relation above the base means. The head portion is further disposable into a collapsed position which is substantially defined by the head portion disposed on the interior of the base means within the hollow interior portion.

Further structural features of the invention include the provision of a lid means pivotally attached to the head portion and being disposable in an exposed position wherein indicia and like informative messages can be placed on the interior surface of the lid means. When the structure is disposed in the collapsed position, the lid means serves to effectively cover or close the hollow interior portion. When in the collapsed position, the overall structure of the assembly is such as to have a height and overall configuration sufficient to allow passage of a vehicle over the assembly so as to allow it to be parked in the space in which the indicator assembly is mounted.

Based on the above, it is obvious that when the head portion is disposed in its outwardly extended position, it serves as a barrier in that it is raised above the base means to a sufficient height to block the entrance of any vehicle into the parking space in which the assembly is mounted. In that the base is substantially fixedly or permanently secured within the space, theft or unauthorized removal of the indicator assembly is prevented. Further, locking means may be mounted in association with the head portion so as to prevent the positioning of the head portion into its collapsed position or alternately from providing access to the interior of the base portion and repositioning the head portion therein when it is desired to maintain the overall assembly into its collapsed position.

An important structural feature of the present invention comprises the existence of the support means designed to include a collapsible structure which includes a first and a second leg component. Correspondingly positioned ends of each leg component are slidably mounted within a track assembly of the head portion and also a track assembly within the base portion. Therefore, the correspondingly positioned opposite ends of each leg component slidably travel along a predetermined length of the head portion and base portion respectively while the head portion is being moved between the two outwardly extended position and collapsed position as set forth above. Further, the two leg components are cooperatively structured so as to be brought in a substantially mating or nesting relation with one another. Therefore in its compact or collapsible position, the entire assembly is of a limited dimension and configuration sufficient to allow passage of an automobile thereover and further to allow adequate room for the vehicle to park in the designated space.

BRIEF DESCRIPTION OF THE DRAWINGS

For a fuller understanding of the nature of the present invention, reference is made to the following detailed description taken in connection with the following drawings, in which.

Like reference characters refer to like parts throughout the several views of the drawings.

DETAILED DESCRIPTION OF THE PREFERRED EMBODIMENT

Figure 1:
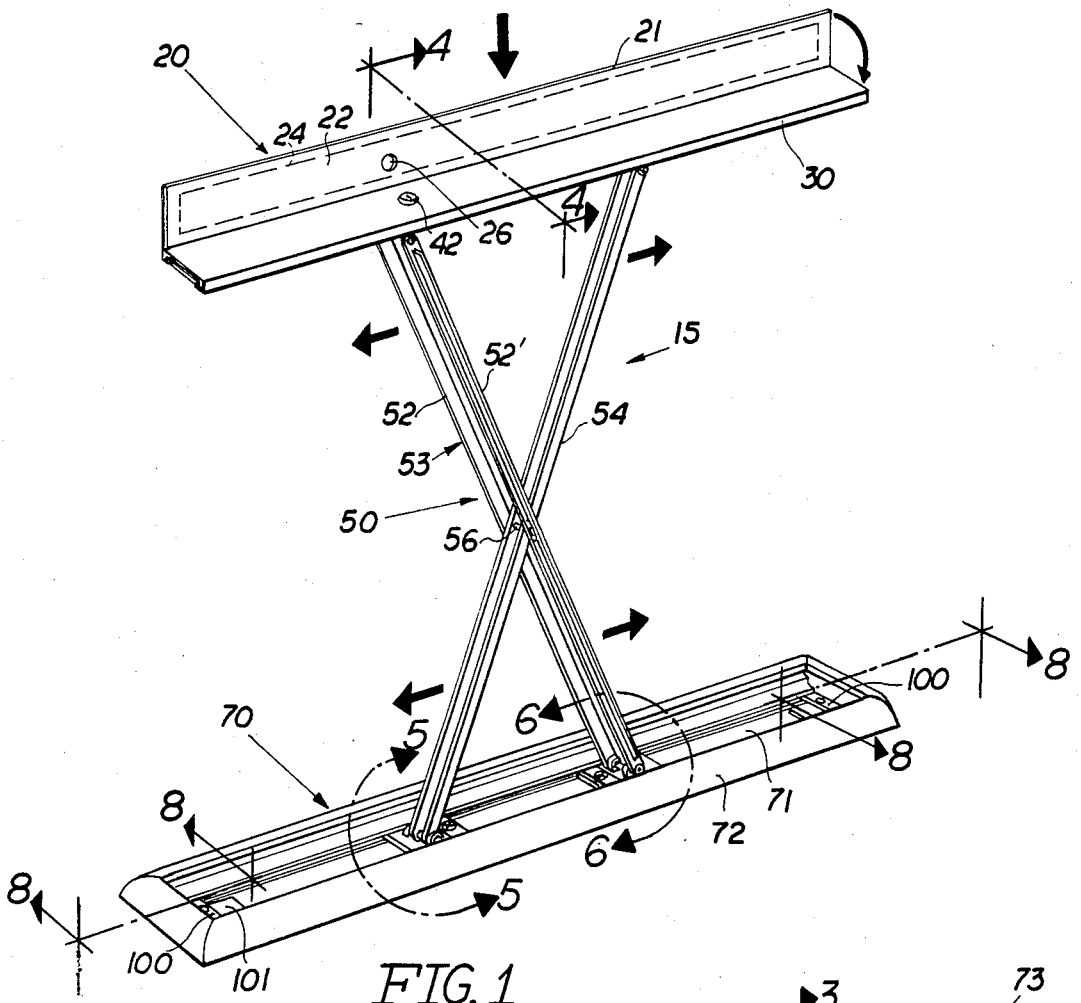
FIG. 1 is an isometric view of the subject assembly in its outwardly extended position.
Figure 2:
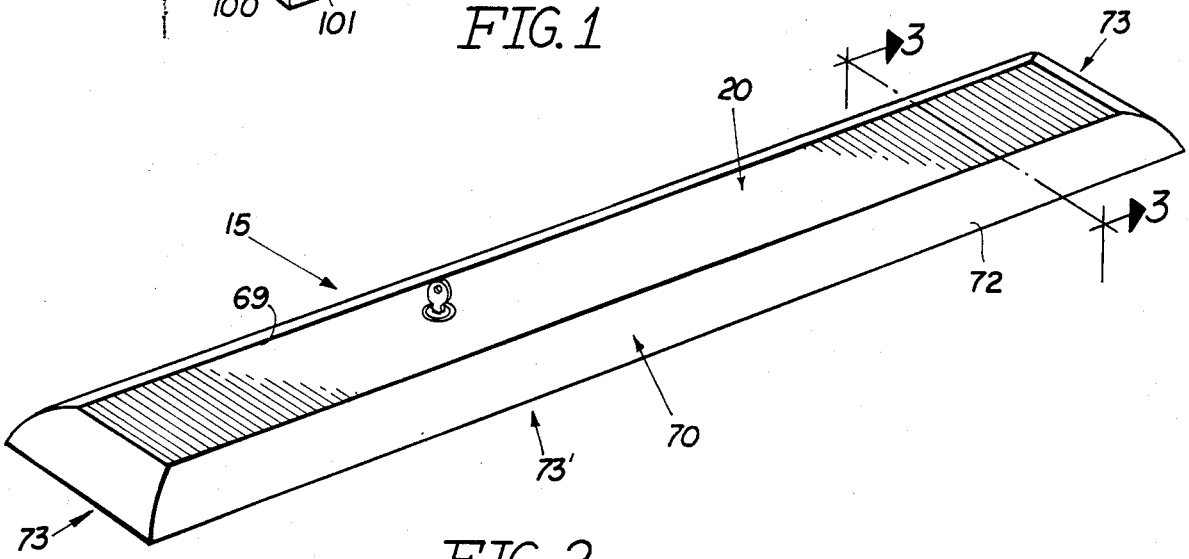
FIG. 2 is an isometric view of the structure of FIG. 1 in its collapsed position.
Figure 8:
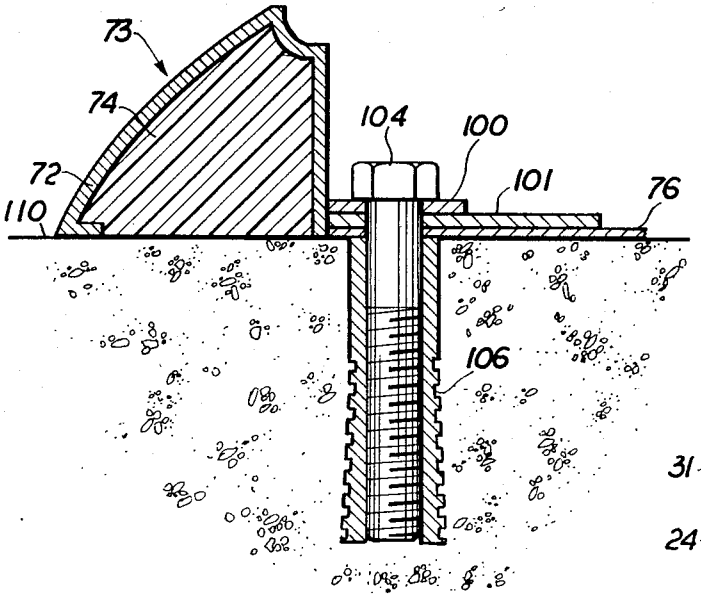
FIG. 8 is a sectional view along line 8—8 of FIG. 1 showhing the end structure and anchoring structure of the subject assembly.

With reference to FIGS. 1 and 2, the present invention is directed towards an indicator and barrier assembly generally indicated as 15 and structured to include a head portion generally indicated as 20, movably interconnected to a base means generally indicated as 70 by a support means generally indicated as 50. More specifically, the base means 70 includes an outer casing 72 which, in the preferred embodiment (FIG. 8), has a reinforcing fill structure 74 which may be fiberglass or like material disposed in supporting relation on the interior of the outer casing 72. The base means 70 includes a substantially hollow interior 71 extending along at least the majority of the length thereof and terminating in an upper opening 69 through which the entire head portion 20 may pass. As will be explained in greater detail hereinafter, the hollow interior portion 71 is specifically configured and dimensioned to house the support means 50, defined in part by a collapsible structure, as well as the head portion 20.

Figure 4:
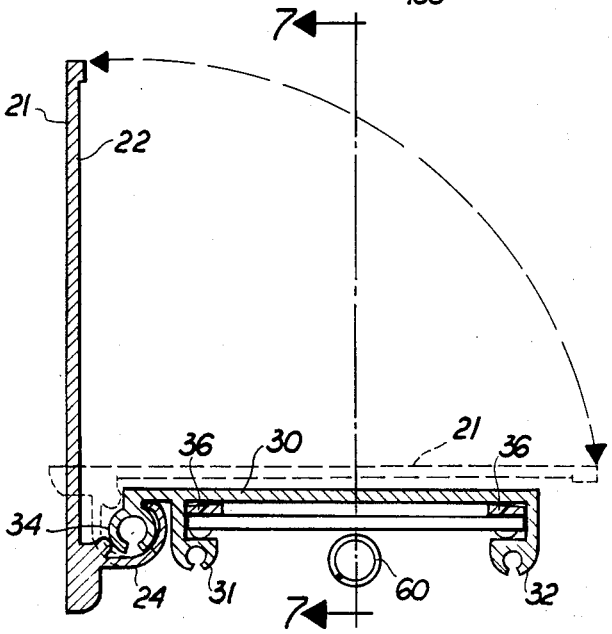
FIG. 4 is a sectional view along line 4—4 of FIG. 1 wherein a closed position of the lid structure is represented in broken lines.

Further, the head portion 20 includes a lid structure 21 pivotally secured (FIG. 4), by an elongated tongue 34 rotatably mounted in curved channel 24, to the barrier platform 30. The lid portion 21 is further dimensioned and configured to serve as a cover when the entire assembly is disposed in its collapsed position on the interior 71 of the base means 70. This cover substantially corresponds to the interior dimensions of the opening 69 and substantially fits therein to close the inteior 71, as best shown in FIG. 2. Again with reference to FIG. 1, an inner surface 22 of the lid element 21 may have indicia or informative material 24 thereon which serves to indicate that the space in which the assembly is mounted is reserved.

With regard to the base means 70, end portions 73 serve to close off opposite ends of the hollow interior portion 71 and each further incorporates a tongue structure 100 (FIG. 8) being apertured to allow passage therethrough of a connector bolt 104. The bolt may be fit within an expandable socket or receiving channel 106 so as to securely anchor or affix the assembly, and in particular the base means 70, to the ground or surface 110 on which it rests.

Figure 3:
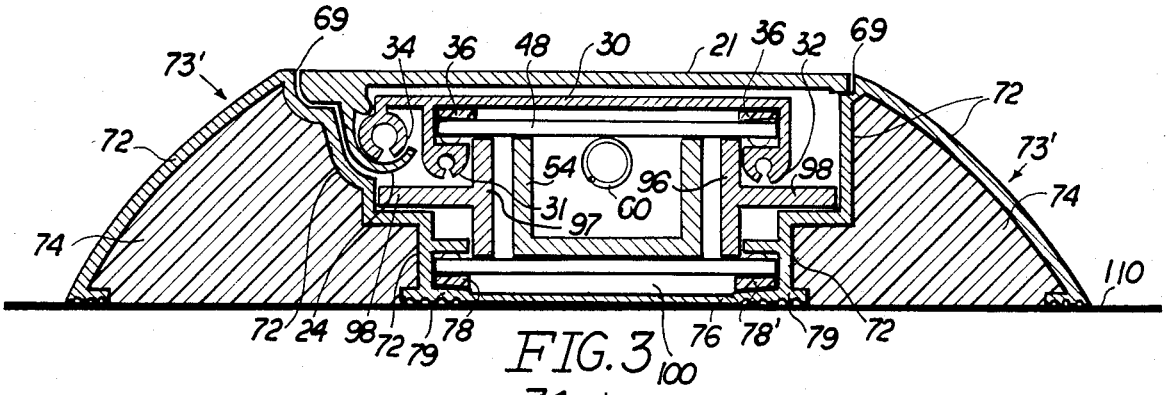
FIG. 3 is a sectional view taken along line 3—3 of FIG. 2 showing the interior structural details and components of the subject assembly.

With reference to FIG. 3, the base means includes elongated side portions 73′ which also have the reinforcing filler 74 made of fiberglass or like material on the interior of casing wall 72. An important structural feature of the present invention is that the wall of the casing 72 may be made of a plastic and/or aluminum or like material which may be extruded into a single piece such that the casing 72, as seen in section in FIG. 3, includes a one-piece construction which extends into the interior of and defines at least in part the boundaries of the hollow interior portion 71. Again with reference to FIG. 3, the casing 72 also includes the platform 76 of the base means forming the lowermost channel or trough thereof. The support runners 79 are also integrally formed as part of the platform 76 so as to have an inwardly angular orientation as will be explained in greater detail hereinafter.

With reference to FIGS. 1, 2, 3 and 5 through 6, the assembly generally indicated at 15 is disposable between an outwardly extended position as represented in FIG. 1 and a collapsed position as shown in FIG. 2. It is obvious that in the outwardly extended position of FIG. 1, the head portion 20 serves as a barrier, along with the support means 50 so as to prevent vehicles from entering into a space in which the assembly 15 is mounted. However, when the assembly is disposed in its collapsed position (FIG. 2), the collective height of the assembly in such position is such as to allow passage of a vehicle thereover so as to not interrupt or serve as a barrier when an authorized vehicle is parked in the designated parking space. Referring to the support means 50, a collapsible structure at least partially defining the supporting means includes a first leg component 54 pivotally interconnected as at 56 to a second leg component 53 wherein the second leg component includes leg portions 52 and 52′ disposed in spaced apart relation to one another in substantially parallel orientation on opposite sides of the first leg component 54. The pivot pin 56 serves to provide pivotal movement of the first and second leg components 54 and 53 respectively relative to one another and such relative movement causes positioning of the head portion between its outwardly extended position (FIG. 1) and its collaped position (FIG. 2) on the interior hollow portion 71 of base means 70.

Figure 5:
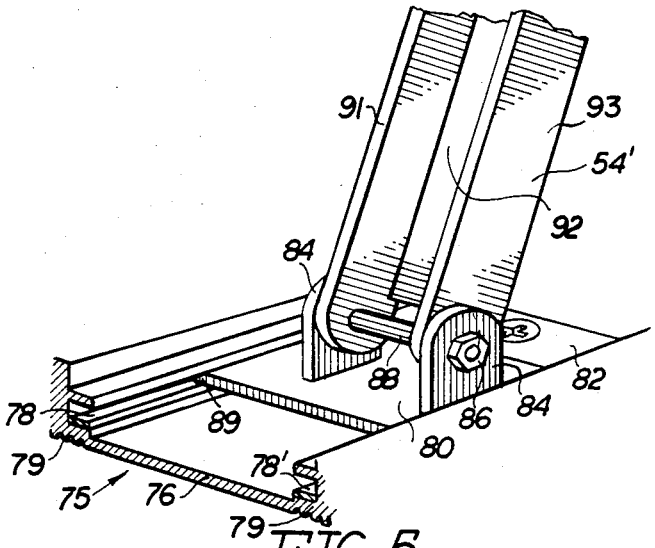
FIG. 5 is an isometric view in partial cutaway showing details of the track assembly and means of movably sliding leg components thereon.
Figure 6:
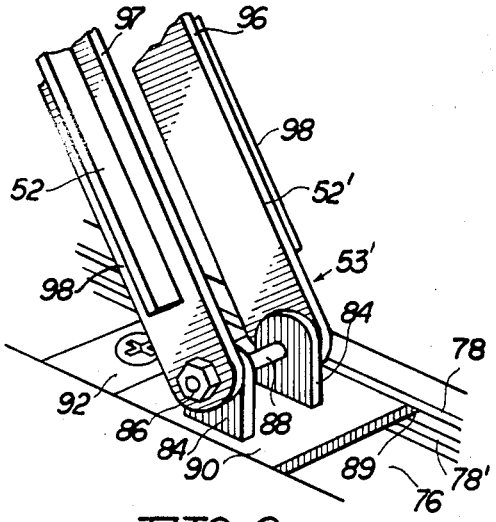
FIG. 6 is an isometric view in partial cutaway showing structural details of another leg component of the present invention.

With specific reference to FIGS. 5, 6, 7, 9 and 10, correspondingly positioned lower ends 54′ and 53′ of first and second leg components 54 and 53 respectively, are each movably mounted within the base means 70. This is accomplished through the provision of track means including a base track assembly 75 formed within the hollow interior portion 71 of the base means 70. As best shown in FIGS. 5 and 6, correspondingly positioned ends 54′ and 53′ are each interconnected to a slide plate 80 and 90 respectively which incudes a pivot pin 88 extended or connected at opposite ends to upstanding ears 84 wherein the pin 88 is secured by a conventional connector element 86. The ears 84 are disposed in spaced apart, substantially parallel relation to one another and fixed at their bottom to the respective slide plates 80 and 90. Slide plates 80 and 90 are disposed and structured to fit within runner channels 78 formed within opposite longitudinal sides of the length of hollow interior portion 71. Therefore, channels 78 effectively overlap the peripheral edges 89 of slide plates 80 and 90 as shown. Further, each of the slide plates 80 and 90 ride above or in spaced relation from the surface of the platform 76 and rest on and travel along runner elements 78' extending along the length and on the interior of the runner channel 78. The runner elements 78' are formed from a Teflon, Nylon or like relatively smooth and friction resistant material so as to allow for easy reciprocal movement of the slide plates thereon. It should be noted that runner elements 78' and runner channels 78 are angularly oriented to substantially slant downwardly and inwardly. This angular orientation allows displacement of dirt and debris when the respective slide plates travel therealong.

Figure 7:
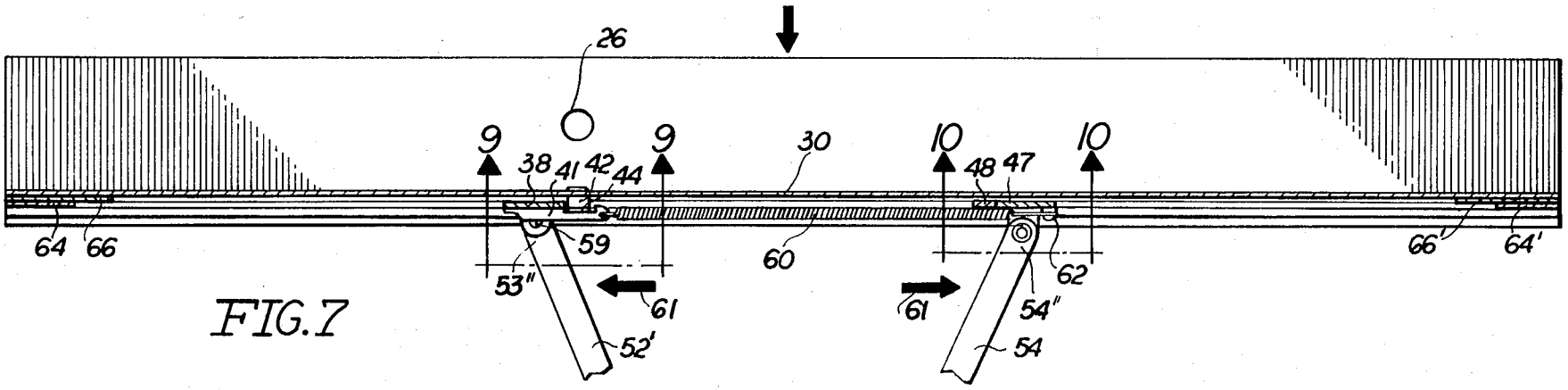
FIG. 7 is a sectional view along line 7—7 of FIG. 4.
Figure 9:
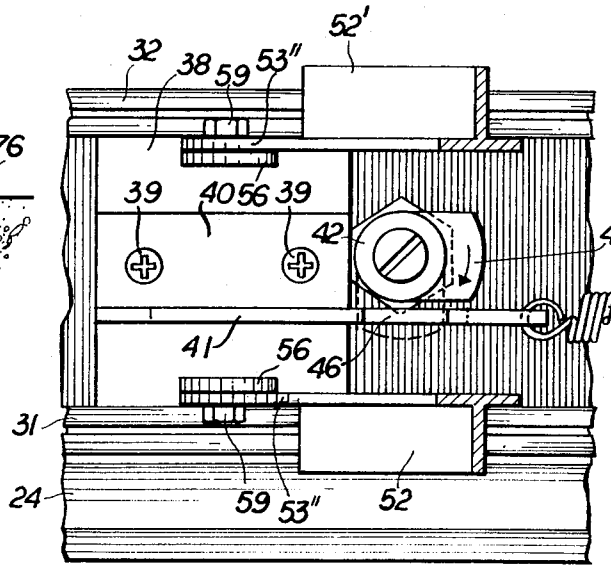
FIG. 9 is a bottom view in partial section along line 9—9 of FIG. 7 showing structural details of the movable attachment of one end of one leg component of the present invention.
Figure 10:
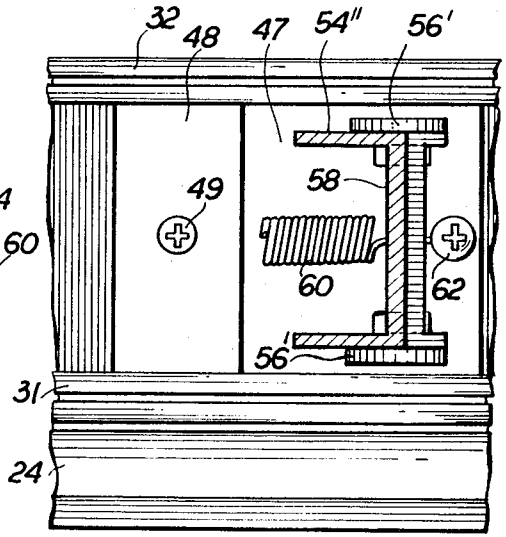
FIG. 10 is a bottom view in partial section along line 10—10 of FIG. 7 showing structural details of the interconnection of the leg component to the track assembly and a stop structure mounted therein.

The track means further includes a head track assembly as shown in FIGS. 7 and 9. Slide plates 38 and 47 are fixedly attached to upstanding ears 56 and 56' respectively which in turn are pivotally connected to end 53" and 54" of the second and first leg components respectively (see FIGS. 9 and 10) wherein slide plate 38 has upstanding ear portions 56' secured thereto. End 53" and 54" of respective leg component 54 and 53 are pivotally secured (FIGS. 7 9 and 10) to the respective slide plates 38 and 47 which are slidably movable in a reciprocal fashion between stop members 64 and 42 and stop members 48 and 64' at the opposite ends of the head track assembly. A retaining spring 60 is interconnected between spring bracket 41 mounted on plate portion 40 by connectors 39 and wherein the opposite end of the spring 60 is connected to spring bracket 58. This spring 60 is disposed and structured to bias the leg ends 53" and 54" of the first leg component 54 and the second leg component 53 respectively towards one another. This in turn tends to bias the overall assembly into its outwardly extended position wherein the head portion 20 is raised above the base means 70. However, when a downward force is exerted on the head portion 20, both the leg component ends 53" and 54" move in opposite directions against the biasing force of spring 60 as indicated by directional arrows 61. While this extends the biasing spring 60, it also forces the head portion down into the interior of the hollow interior 71 of the base means 70.

Further with regard to the stop means described above with reference to FIGS. 5 and 6, slide plates 80 and 90 associated with ends 54' and 53' of the respective leg components are meant to travel a limited distance within the base track assembly 75. This distance is defined by intermediate stop members 82 and 92 disposed in interruptive relation to the path of travel of slide plates 80 and 90 respectively. Similarly, at the opposite ends of the base track assembly 75, tongue portions 100 are disposed at the extreme opposite ends of the base track assembly 75 and also are disposed in interruptive relation to the path of travel of slide plates 80 and 90. Therefore, as the head portion moves between its outwardly extended position and is collapsed position on the interior of the base means 70, the respective slide plates 80 and 90 move between opposite end stop members 100, also serving as the tongue portions for mounting of anchor connector 104, and the intermediate stop members 82 and 92 respectively.

Other structural features of the present invention include bearing pads 66 and 66' located at opposite ends of the track assembly on the undersurface of the barrier portion 30 of the head portion 20. These serve to pass beneath the slide plates 38 and 47 and to absorb a certain amount of the force or weight exerted thereon when the head portion is maintained on the hollow interior portion 71 of the base means 70. Similarly, bearing pads 101 are located at opposite ends of the base means on the interior thereof and substantially adjacent to the end portion 73' of the base means and beneath the mounting tongue 100 associated with the anchor connector element 104. These bearing pads pass beneath slide plates 80 and 90 associated with the base track assembly and serve to bear the weight of certain of the components when the assembly is in its collapsed position.

Further structural features include the specific structure of the first and second leg components 54 and 53 respectively wherein the first leg component 54 is formed from a single one-piece construction having spaced apart but integrally secured leg portions 93 and 91 interconnected by span 92. However, the second leg component (see FIGS. 3 and 6) includes spaced apart leg portions 96 and 97 disposed substantially parallel to one another but not having an interconnectng span similar to span 92 of the first leg component 54. Support flanges 98 extend outwardly from the outer longitudinal surfaces of the leg portions 96 and 97 of the second leg component 53. As best shown in FIG. 3, the spaced apart orientation of the leg components 96 and 97 and their spaced apart distance allows the leg portions 93 and 91 of the first leg component 54 to fit therebetween and thereby establish a nesting relation between the first and second leg components on the interior of the base means within the hollow interior portion 71. This nesting alignment allows for compact disposition of the structural components of the subject assembly and further allows for an overall, collective height being such to allow a vehicle to pass thereover when the overall assembly (FIG. 2) is disposed in its collapsed position.

It is to be understood therefore that the following claims are intended to cover all of the generic features of the invention herein described, and all statements of the scope of the invention which, as a matter of language, might be said to fall therebetween.

Now that the invention has been described,

What is claimed is:

1. An indicator assembly of the type primarily designed for mounting in a parking space and structured for vehicle blocking disposition therein, said indicator assembly comprising:

(a) base means for securely mounting said indicator assembly within a vehicle parking space and including a substantially hollow interior portion, said base means comprising a substantially one-piece structured casing reinforcing means for strengthening said casing and connected in at least partially surrounded relation to said casing, (b) said casing including a hollow interior defining said hollow interior portion of said base means, (c) a head portion movably interconnected to said base means and structured to extend outwardly therefrom in spaced relation thereto, (d) support means movably attached to said base means and movably secured in substantially supporting relation to said head portion for support thereof, (e) said support means comprising a collapsible structure movably attached to both said head portion and said base means and interconnected therebetween, (f) said collapsible structure disposable between an outwardly extended position, defined by outward disposition of said head portion relative to said base means, and a collapsed position, defined by substantially adjacent relative disposition between said base means and said head portion, (g) said head portion when collapsed and said base means dimensioned to have a collective height sufficient to pass under a parked vehicle within the parking space, (h) said hollow interior of said casing being dimensioned and configured to house said support means and said head portion substantially therein when in said collapsed position, and (i) lid means pivotally connected to said head portion and selectively disposable between an upstanding, exposed position and a reclined position, said lid means dimensioned and configured to substantially cover said hollow interior portion when said lid means is in said reclined position.

2. An indicator assembly of the type primarily designed for mounting in a parking space and structured for vehicle blocking disposition therein, said indicator assembly comprising:

(a) base means for securely mounting said indicator assembly within a vehicle parking space and including a casing, said casing structured to include a hollow interior, (b) a head portion movably interconnected to said base means and structured to extend outwardly therefrom in spaced relation thereto, (c) support means movably attached to said base means and movably secured in substantially supporting relation to said head portion for support thereof, (d) said support means comprising a collapsible structure movably attached to both said head portion and said base means and interconnected therebetween, (e) said collapsible structure disposable between an outwardly extended position, defined by outward disposition of said head portion relative to said casing, and a collapsed position, defined by substantially adjacent relative disposition between said base means and said head portion, (f) said head portion when collapsed and said base means dimensioned to have a collective height sufficient to pass under a parked vehicle within the parking space, (g) said hollow interior of said casing dimensioned and configured to house said support means and said head portion concurrently therein when said head portion is in said collapsed position.

3. An assembly as in claim 2 further comprising lid means secured to said head portion and structured for substantially covering said hollow interior of said casing when said head portion and said support means are positioned in said collapsed position within said casing, said lid means being pivotally connected to said head portion and selectively disposable between an upstanding exposed position and a reclined position, said lid means dimensioned and configured to substantially cover said hollow interior of said casing when in said reclined position.

4. An assembly as in claim 2 wherein said collapsible structure comprises a first and a second leg component each pivotally connected to one another substantially intermediate the ends thereof, each of said leg components having correspondingly disposed opposite ends slidably interconnected to said head portion and said base means respectively, said leg components movably attached and cooperatively structured to cause sliding movement of correspondingly disposed ends along said head portion and base means respectively upon relative pivotal movement of said leg components.

5. An assembly as in claim 4 further comprising track means for movably interconnectng said first and said second leg component to said head portion and said base means and including a base track assembly mounted on said base means and a head track assembly mounted on said head portion; correspondingly positioned opposite ends of said first and said second leg components slidably interconnected to travel along said track means of each of said base track and head track assemblies.

6. An assembly as in claim 4 wherein said collapsed position is further defined by substantially parallel, nested relation of said first and said second leg components substantially within said hollow interior portion.

7. An assembly as in claim 6 wherein said first leg component comprises a substantially one-piece construction having an elongated configuration and said second leg component comprising spaced apart substantially parallel leg portions extending the length of said second leg component; said nested relation at least partially defined by said first leg component disposed within and between said second leg portions of said second leg component.

8. An assembly as in claim 6 wherein said outwardly extended position comprises said first and said second leg components disposed in substantially angular orientation to one another and said head portion disposed in spaced relation above said base means.

9. An assembly as in claim 5 further comprising a slide bracket assembly secured to each opposite end of each of said leg components, each of said slide brackets including a slide plate dimensioned and configured in cooperation with said respective track assemblies so as to be at least partially retained therein and slide therealong.

10. An assembly as in claim 9 further comprising stop means including a plurality of stop elements mounted in each of said track assemblies in predetermined, spaced relation to one another and in interruptive relation to the path of travel of each slide plate, at least two of said plurality of stop elements cooperatively disposed in predetermined spaced relation to each other and on opposite sides of one slide plate so as to limit linear travel thereof in opposite directions.

11. An assembly as in claim 9 wherein said base track assembly comprises a track platform disposed to substantially slidably support said slide plate thereon, said track platform including a substantially inclined portion angularly oriented toward an opening in said base track assembly, whereby debris within said base track assembly is forced out of said inclined portion.

12. An assembly as in claim 9 further comprising load bearing means formed at opposite ends of each of said base track assembly and head track assembly and each disposed and dimensioned for disposition in underlying, substantially load bearing relation to one of said slide plates when said first and said second leg components are disposed in said collapsed position.

13. An indicator assembly of the type primarily designed for mounting in a parking space and structured for vehicle blocking disposition therein, said indicator assembly comprising:

(a) base means for securely mounting said indicator assembly within a vehicle parking space and including a casing, said casing structured to include a hollow interior, (b) a head portion movably interconnected to said base means and structured to extend outwardly therefrom in spaced relation thereto, (c) support means movably attached to said base means and movably secured in substantially supporting relation to said head portion for support thereof, (d) said support means comprising a collapsible structure movably attached to both said head portion and said base means and interconnected therebetween, (e) said collapsible structure disposable between an outwardly extended position, defined by outward disposition of said head portion relative to said casing, and a collapsed position, defined by substantially adjacent relative disposition between said base means and said head portion, (f) said head portion when collapsed and said base means dimensioned to have a collective height sufficient to pass under a parked vehicle within the parking space, (g) said head portion comprising a barrier member oriented in substantially horizontal position relative to said base means and having a longitudinal dimension substantially less than said hollow interior of said casing and including an overall dimension sufficient to substantially fit within said casing, (h) said hollow interior of said casing dimensioned and configured to house said support means and said head portion concurrently therein when said head portion is in said collapsed position.

14. An assembly as in claim 13 further comprising lid means hingedly secured to said barrier member and disposed substantially along the length thereof, said lid means dimensioned and configured to be pivotally disposed in covering relation to said hollow interior portion.

15. An assembly as in claim 14 wherein said lid means comprises a sign means formed on an inner surface thereof, said lid means pivotally disposed out of covering relation to said hollow interior portion and into a substantially upstanding position, whereby said sign means on said inner surface is exposed for viewing.

* * * * *